US007484811B2

(12) United States Patent
Chang

(10) Patent No.: US 7,484,811 B2
(45) Date of Patent: Feb. 3, 2009

(54) APPARATUS FOR SUPPORTING A PERSON AND METHOD OF FORMING THEREOF

(76) Inventor: James L. Chang, 289 Lake Ave., Saratoga Springs, NY (US) 12866-3758

( * ) Notice: Subject to any disclaimer, the term of this patent is extended or adjusted under 35 U.S.C. 154(b) by 0 days.

(21) Appl. No.: 11/381,706

(22) Filed: May 4, 2006

(65) Prior Publication Data

US 2007/0216213 A1 Sep. 20, 2007

Related U.S. Application Data

(60) Provisional application No. 60/782,495, filed on Mar. 15, 2006.

(51) Int. Cl.

| | |
|---|---|
| ***A47C 7/22*** | (2006.01) |
| ***D04B 1/18*** | (2006.01) |
| ***D04B 7/16*** | (2006.01) |
| ***D04B 1/12*** | (2006.01) |
| ***D04B 21/14*** | (2006.01) |

(52) U.S. Cl. ..... 297/452.63; 297/452.13; 442/306

(58) Field of Classification Search ..... 297/452.13, 297/452.63; 442/306

See application file for complete search history.

(56) References Cited

U.S. PATENT DOCUMENTS

| | | | | |
|---|---|---|---|---|
| 4,522,447 | A * | 6/1985 | Snyder et al. | 297/452.27 |
| 4,602,816 | A * | 7/1986 | Chandler | 297/452.63 X |
| 4,732,426 | A | 3/1988 | Brudermann et al. | |
| 4,796,316 | A | 1/1989 | Boselli | |
| 4,844,969 | A | 7/1989 | Chang | |
| 4,944,060 | A | 7/1990 | Perry et al. | |
| 5,077,849 | A | 1/1992 | Farley | |
| 5,226,185 | A | 7/1993 | Guay et al. | |
| 5,459,896 | A | 10/1995 | Raburn et al. | |
| 5,494,725 | A | 2/1996 | Fejes | |
| 5,511,260 | A | 4/1996 | Dinsmoor, III et al. | |
| 5,568,660 | A | 10/1996 | Raburn et al. | |
| 5,592,707 | A | 1/1997 | Dinsmoor, III et al. | |
| 5,655,241 | A | 8/1997 | Higgins et al. | |
| 5,669,094 | A | 9/1997 | Swanson | |
| 5,680,662 | A | 10/1997 | Purdy et al. | |
| 5,709,428 | A * | 1/1998 | Hugghins | 297/45 X |
| 5,857,749 | A | 1/1999 | DeBellis et al. | |
| 6,006,383 | A | 12/1999 | Pile et al. | |
| 6,159,877 | A | 12/2000 | Scholz et al. | |
| 6,192,538 | B1 | 2/2001 | Fogel | |
| 6,315,364 | B1 | 11/2001 | Fujita et al. | |

(Continued)

*Primary Examiner*—Rodney B. White
(74) *Attorney, Agent, or Firm*—Gerald F. Dudding; GFD Patents LLC

(57) ABSTRACT

An apparatus having a fabric and method of forming thereof. The fabric's load bearing surface for supporting a load, comprising: at least one layer(s) ($L_n$) wherein n=0, −1, −2, . . . −i, wherein n=0 represents the at least one layer(s) ($L_n$) of the load bearing surface that contacts the load. An n=−1, −2, . . . −i, represents successive underlying at least one layer(s) ($L_n$) of the load bearing surface. An n=−i, represents a bottom underlying at least one layer(s) ($L_n$). The fabric consists essentially of a polyurethane fiber and a fiber that is chemically different from the polyurethane fiber, and wherein the fabric has been stretched to the point just before encountering the Young's Modulus. The method comprising: cutting the fabric to a predetermined pattern; and stretching the fabric to the point just before encountering the Young's Modulus.

29 Claims, 10 Drawing Sheets

U.S. PATENT DOCUMENTS

| | | | | |
|---|---|---|---|---|
| 6,343,394 | B1 | 2/2002 | Gandolfi | |
| 6,421,859 | B1 | 7/2002 | Hicks et al. | |
| 6,428,865 | B1 | 8/2002 | Huang | |
| 6,481,033 | B2 | 11/2002 | Fogel | |
| 6,550,085 | B2 | 4/2003 | Roux | |
| 6,602,579 | B2 | 8/2003 | Landvik | |
| 6,644,070 | B2 | 11/2003 | Ikenaga et al. | |
| 6,701,529 | B1 | 3/2004 | Rhoades et al. | |
| 6,702,390 | B2 | 3/2004 | Stumpf et al. | |
| 6,901,617 | B2 | 6/2005 | Sprouse, II et al. | |
| 6,942,300 | B2 | 9/2005 | Nema et al. | |
| 7,073,865 | B2 * | 7/2006 | Haynes et al. | 297/463.2 |
| 7,237,841 | B2 * | 7/2007 | Norman et al. | 297/301.3 |
| 2001/0027281 | A1 | 10/2001 | Dabir | |
| 2002/0157429 | A1 | 10/2002 | Matsumoto | |
| 2002/0171283 | A1 | 11/2002 | Liebeskind | |
| 2002/0180249 | A1 | 12/2002 | Felton et al. | |
| 2003/0009831 | A1 | 1/2003 | Giori et al. | |
| 2003/0061663 | A1 | 4/2003 | Lampel | |
| 2003/0135929 | A1 | 7/2003 | Dennison et al. | |
| 2003/0176820 | A1 | 9/2003 | Dabir | |
| 2003/0205920 | A1 | 11/2003 | Sprouse, II et al. | |
| 2003/0221262 | A1 | 12/2003 | Torbet et al. | |
| 2004/0095006 | A1 | 5/2004 | Chen | |
| 2004/0123391 | A1 | 7/2004 | Call | |
| 2004/0139552 | A1 | 7/2004 | Walters, Jr. | |
| 2004/0140701 | A1 | 7/2004 | Schmitz et al. | |
| 2004/0145230 | A1 | 7/2004 | Fujita et al. | |
| 2004/0160111 | A1 | 8/2004 | Koffler | |
| 2005/0154336 | A1 | 7/2005 | Kloecker et al. | |
| 2006/0033375 | A1 | 2/2006 | Wu | |

* cited by examiner

APPARATUS FOR SUPPORTING A PERSON AND METHOD OF FORMING THEREOF

The present patent application is a non-provisional application claiming priority from provisional application Ser. No. 60/782,495, filed Mar. 15, 2006 and titled "Apparatus For Supporting a Person and Method of Forming Thereof".

FIELD OF USE

This invention relates generally to a support structure for supporting a person in a sitting or reclining position. More particularly the present invention relates to a chair that distributes pressure that arises from contact of a supporting surface and pressure points such as the ischium, the shoulder blades, tail bone and heels across the whole supporting surface when the person is sitting or reclining in the chair.

BACKGROUND

There is a need in the chair industry for a structure that enables a person to sit for long periods without developing pressure sores or ailments that result from incorrect posture while the person is in a sitting position. Prevention of pressure sores is a major concern of hospitals, nursing homes, and other medical facilities that care for people with limited mobility either because of injury or infirmity.

Pressure sores are known to develop in individuals on their skin at the ischium, which is at the base of the buttocks. Limited mobility can place extended pressure on an area of their body where their body contacts the fabric of a supporting device, such as a chair.

There is a need for supporting devices that reduce the pressure on the area of the body where their body contacts the fabric of the supporting device when sitting or reclining in the supporting device.

SUMMARY OF THE INVENTION

One aspect of the present invention includes an apparatus having a load bearing surface, comprising: a chair frame for stretching a fabric having at least one layer(s) ($L_n$), wherein n=0, −1, −2, . . . −i, wherein n=0 represents the at least one layer(s) ($L_n$) of the load bearing surface that contacts the load, wherein n=−1, −2, . . . −i, represents successive underlying at least one layer(s) ($L_n$) of the load bearing surface, wherein n=−i, represents a bottom underlying at least one layer(s) ($L_n$) of the load bearing surface, wherein the fabric consists essentially of a polyurethane fiber and a fiber that is chemically different from the polyurethane fiber, and wherein the fabric has been stretched between members of the chair frame so that the fabric's percent elongation approaches but is less than the percent elongation for the Young's Modulus.

A second aspect of the present invention includes a fabric having a load bearing surface, comprising at least one layer(s) ($L_n$) consisting essentially of a polyurethane fiber and a fiber that is chemically different from the polyurethane fiber, wherein n=0, −1, −2, . . . −i, wherein n=0 represents the at least one layer ($L_n$) of the load bearing surface that contacts the load, wherein n=−1, −2, . . . −i, represents successive underlying at least one layer(s) ($L_n$) of the load bearing surface, wherein n=−i, represents a bottom underlying at least one layer ($L_n$) of the load bearing surface, wherein the fabric has been stretched to the point just before encountering the Young's Modulus, and wherein the fabric has at least one opening(s) therein, and wherein a long axis of the at least one opening(s) is in a wale direction of the fabric.

A third aspect of the present invention includes a method of making a chair having a load bearing surface comprising the steps of: providing a frame for stretching a fabric having at least one layer(s) ($L_n$), wherein n=0, −1, −2, . . . −i, wherein n=0 represents the layer ($L_n$) of the load bearing surface that contacts the load, wherein n=−1, −2, . . . −i represents successive underlying at least one layer(s) ($L_n$) of the load bearing surface, wherein n=−i represents a bottom underlying layer ($L_n$) of the supporting surface, wherein the fabric consists essentially of a polyurethane fiber and a fiber that is chemically different from the polyurethane fiber; cutting the at least three layers ($L_n$) to a predetermined pattern; and stretching the at least three layers ($L_n$) of fabric so that the fabric has been stretched to the point just before encountering the Young's Modulus.

A fourth aspect of the present invention includes a method of making a fabric having a load bearing surface, comprising the steps of: providing at least one layer(s) ($L_n$) consisting essentially of a polyurethane fiber and a fiber that is chemically different from the polyurethane fiber, wherein n=0, −1, −2, . . . −i, wherein n=0 represents the layer ($L_n$) of the load bearing surface that contacts the load, wherein n=−1, −2, . . . −i represents successive underlying at least one layer(s) ($L_n$) of the load bearing surface, wherein n=−i represents a bottom underlying at least one layer ($L_n$) of the load bearing surface, wherein the at least one layer(s) ($L_n$), except n=0 and n=−i has at least one opening(s), wherein a long axis of the at least one opening(s) is in a wale direction of the fabric, and wherein the at least one opening(s) are aligned so that a center of each at least one opening(s) underlies a pressure point of the user.

DETAILED DESCRIPTION OF THE INVENTION

Although certain embodiments of the present invention will be shown and described in detail, it should be understood that various changes and modifications might be made without departing from the scope of the appended claims. The present invention is based on advancements in the field of orthopedic support.

Figure 1A:
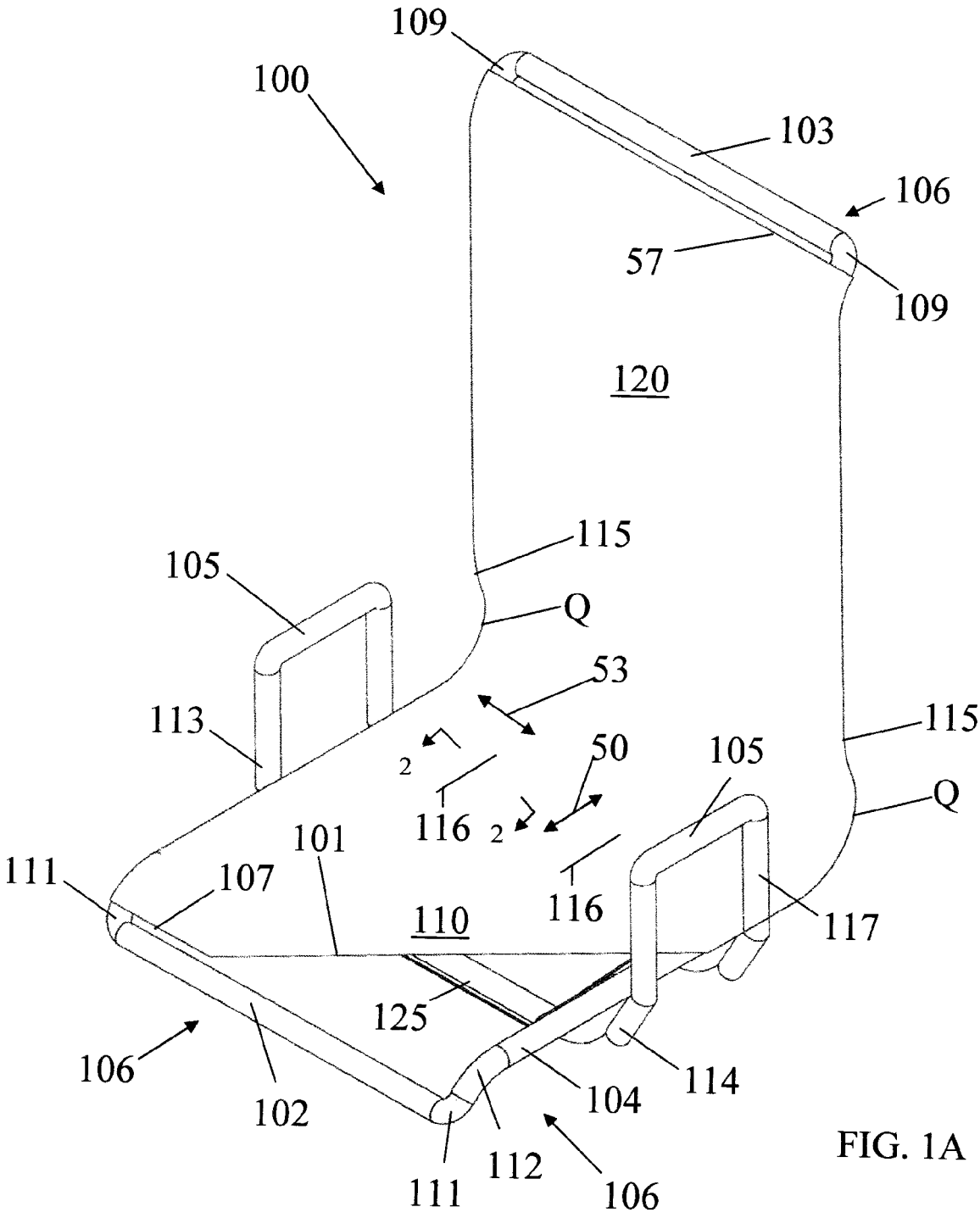
FIG. 1A depicts a front isometric view of the supporting structure, in accordance with embodiments of the present invention.

FIG. 1A depicts a front isometric view of a supporting structure 100, wherein one embodiment is advantageously directed to an orthopedic chair. Hereinafter, the supporting structure 100 is not the orthopedic sleeping support such as a bed disclosed in U.S. Pat. No. 4,884,969, authored by the present inventor, because a purpose of the structure 100 is to provide a supporting structure 100 that promotes improved posture for a person in a sitting position by supporting a person's knees and buttocks so that the person's knees are elevated relative to the person's buttocks. Hereinafter, "posture" is the mechanical relationship of the parts of the body to each other. It can be divided into static posture (at rest or without anticipated movement, e.g. lying, sitting or standing), and dynamic posture (in action or anticipation of action). Here, the degree of normalcy of a person's spinal curvature in the lumbar region of his/her back and whether the center of body mass is located about 1 inch forward of the second sacral vertebrae, as is expected in the average person, were criteria used to determine whether there was an improvement in the person's static posture before and after the person's knees were elevated relative to the person's buttocks. The degree of normalcy of curvature of the lumbar region and the location of the center of gravity were determined using appropriate methods such as measurements with a ruler or a plum device, respectively.

Figure 5:
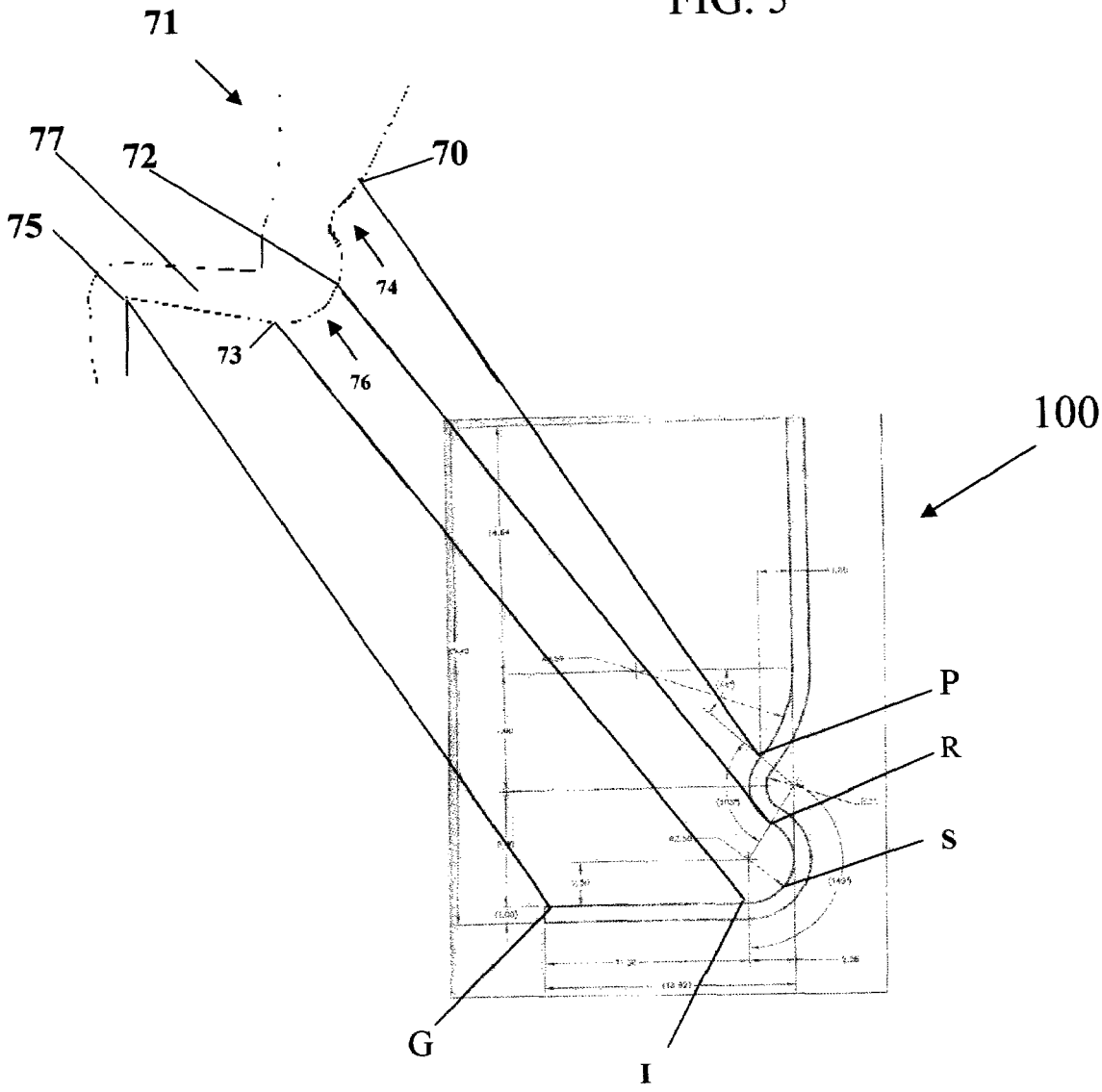
FIG. 5 depicts the longitudinal side view of the chair frame of the orthopedic support, as depicted in FIG. 4, further comprising a sagittal cross section or sagittal plane of a person, in accordance with embodiments of the present invention.
Figure 6:
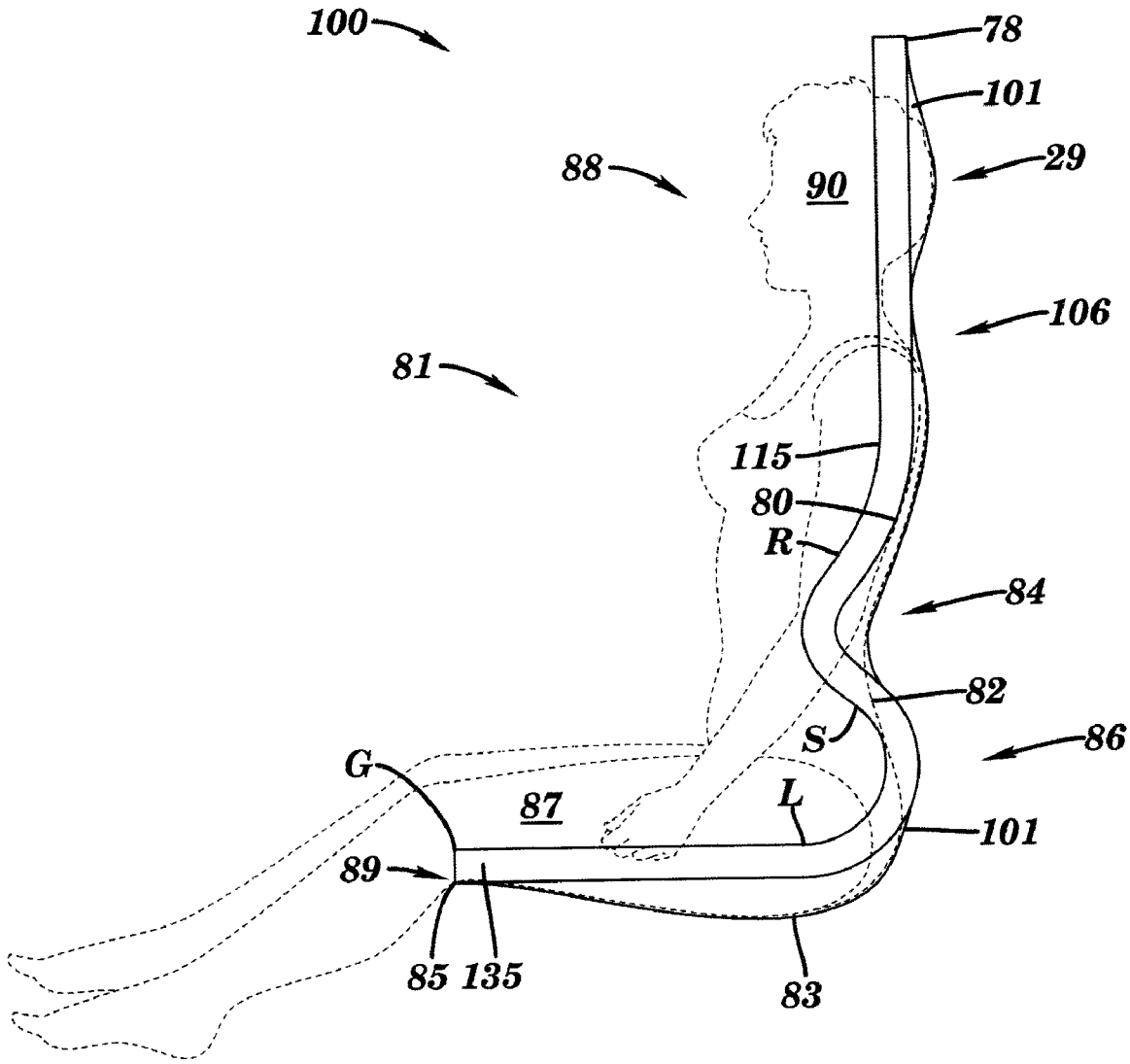
FIG. 6 depicts the longitudinal side view of the chair frame of the orthopedic support, as depicted in FIG. 4, further comprising a sagittal cross section or sagittal plane of a person, in accordance with embodiments of the present invention.

The inventor discloses that in every case the orthopedic structure 100 improved the sitting posture of the person, e.g. adjusted the person's spinal curvature in the lumbar region closer to normal and adjusted the person's center of gravity forward of the second sacral vertebrae closer to the average by providing higher tension under the knee 75, 85, and at the lumbar portion 74, 84, because the knee 75, 85, was raised to a higher position than the buttocks portion 76, 86, which relieved the pressure on the lumbar portion 74, as depicted in FIGS. 5 and 6 and described in associated text, infra.

Hereinafter, the term "orthopedic chair" means a chair that prevents or corrects injuries such as sores, pressure sores or disorders of the skeletal system and associated muscles, e.g. correcting posture, joints, and ligaments that arise at the ischium when the person is supported in a sitting position in a chair at the shoulder blades, tail bone and heels when the person is sitting or reclining in the chair. The orthopedic surfaces of the present invention prevent or correct said injuries because essentially zero resistance on pressure point(s) of the user allow normal blood flow in tissues supported by the orthopedic structures of the present invention so that the incidence of sores is minimized.

Hereinafter "chair" means a piece of furniture designed to accommodate one person consisting of a seat, legs, back, and often arms, wherein the seat, legs, back, and arms are fixed or held in place by a frame.

The supporting structure 100 comprises a fabric having at least one layer(s) 101 operationally or operably coupled to a continuous and coextensive chair frame 106, wherein operationally or operably coupling the fabric means stretching the fabric between rigid chair frame support members, e.g. 102, 103, 104, 109, 111, and 112, beyond moduli conventionally employed in the chairmaking industry, but short of the Young's Modulus for the particular composite fibers, wherein the stretched condition enables the stretched fabric having the at least one layer(s) 101 to uniformly and evenly distribute the weight of a person supported by the bearing surfaces 110 and 120. The stretched condition provides a load bearing surface 110, 120 that distributes pressure that arises from contact of the support bearing surface(s) 110 and 120 and pressure points such as the ischium, the shoulder blades, tail bone and heels across the whole support bearing surface(s) 110, 120 when the person is sitting or reclining in the support structure 100. Hereinafter, the "ischium" or the "ischium protruberance" is the bone making up the lower down back part of the pelvis.

The supporting structure 100 is an improvement over other orthopedic chairs because the bearing surface 110 consists essentially of at least one layer(s) 101 of a soft, flexible elastic fabric, knitted with polyurethane and another polymer fiber such as polyester or polyamide. Lycra® is a registered trademark used for DuPont's polyurethane fiber.

Referring to FIG. 1A, the bearing surface(s) of a standard chair may include an unyielding surface such as wood or metal which may be unable to provide uniform support over the entire surface area of a user. Uniform support is likewise not achieved by chairs with cushioned bearing surfaces(s), for example layers of padding or a series of springs, when placed over the unyielding surface or used independent of a solid base support. Standard cushioned bearing surfaces have the inherent defect and disadvantage of providing a constant rate of loading under increased pressure, thereby providing greater pressure under specific regions of a person supported by the bearing surface, and accordingly less pressure under other regions of the person.

There is a need for an orthopedic supporting structure 100 capable of avoiding the linearity of loading typified by the bearing surfaces 110 and 120 of a standard chair. Accordingly, the present invention discloses an orthopedic supporting structure 100 capable of pressure distribution to support the lumbar region of a person's back, thereby relieving lumbar tension, and reducing the force exerted on pressure points of a user to essentially zero. In addition to its simple construction, low volume of space, and ability to minimize noise when subjected to heavy body weights or undue twisting, the orthopedic supporting structure 100 of the present invention may also be fabricated to prescription to address specific pressure point criteria of an individual.

Production of the interlocking pattern of polymeric fibers that comprise the at least one layer(s) 101 of the fabric, which provides the bearing surface(s) 110 and 120 of the disclosed invention, including the fibers used, the weaving process, and post-weaving processing steps, as well as the physical characteristics of the resulting fabric 10 are disclosed in U.S. Pat. No. 4,884,969, authored by the present inventor, hereby incorporated by reference.

The supporting structure 100 may be a fabric having a load bearing surface(s) 110 or 120 for supporting a load, comprising: at least one layer(s) ($L_n$) wherein n=0, 31 1, −2, . . . −i, wherein n=0 represents the at least one layer(s) ($L_n$) of the load bearing surface that contacts the load. The n=−1, −2, . . . −i, represents successive underlying at least one layer(s) ($L_n$) of the load bearing surface, wherein n=−i, represents a bottom underlying at least one layer(s) ($L_n$) of the load bearing surface. The fabric consists essentially of a polyurethane fiber and a fiber that is chemically different from the polyurethane fiber, and wherein the fabric has been stretched to the point just before encountering the Young's Modulus.

In one embodiment, the load is advantageously a person.

The load bearing surface(s) 110 and 120 may be the bearing surface(s) 110 and 120, of a chair, automobile seat, or wheel chair. The bearing surface(s) 110 and 120 may be comprised of at least one layer(s) 101 of a fabric operationally or operably coupled to the chair frame 106.

Figure 2:
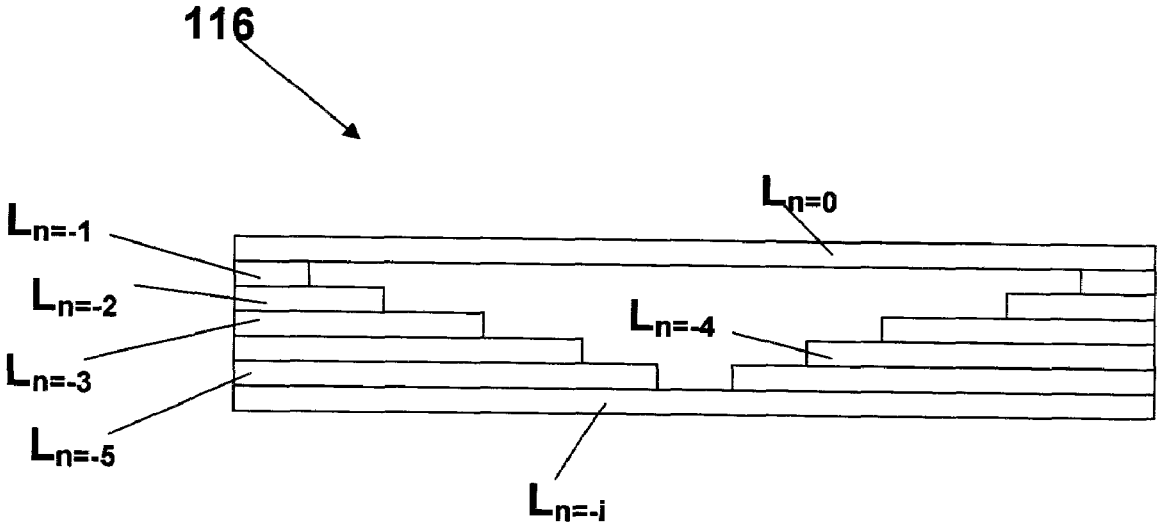
FIG. 2 depicts a front cross sectional view of the bearing surface of the orthopedic support showing the multiple layers of fabric in the Funnel-Out pattern, in accordance with embodiments of the present invention.
Figure 4:
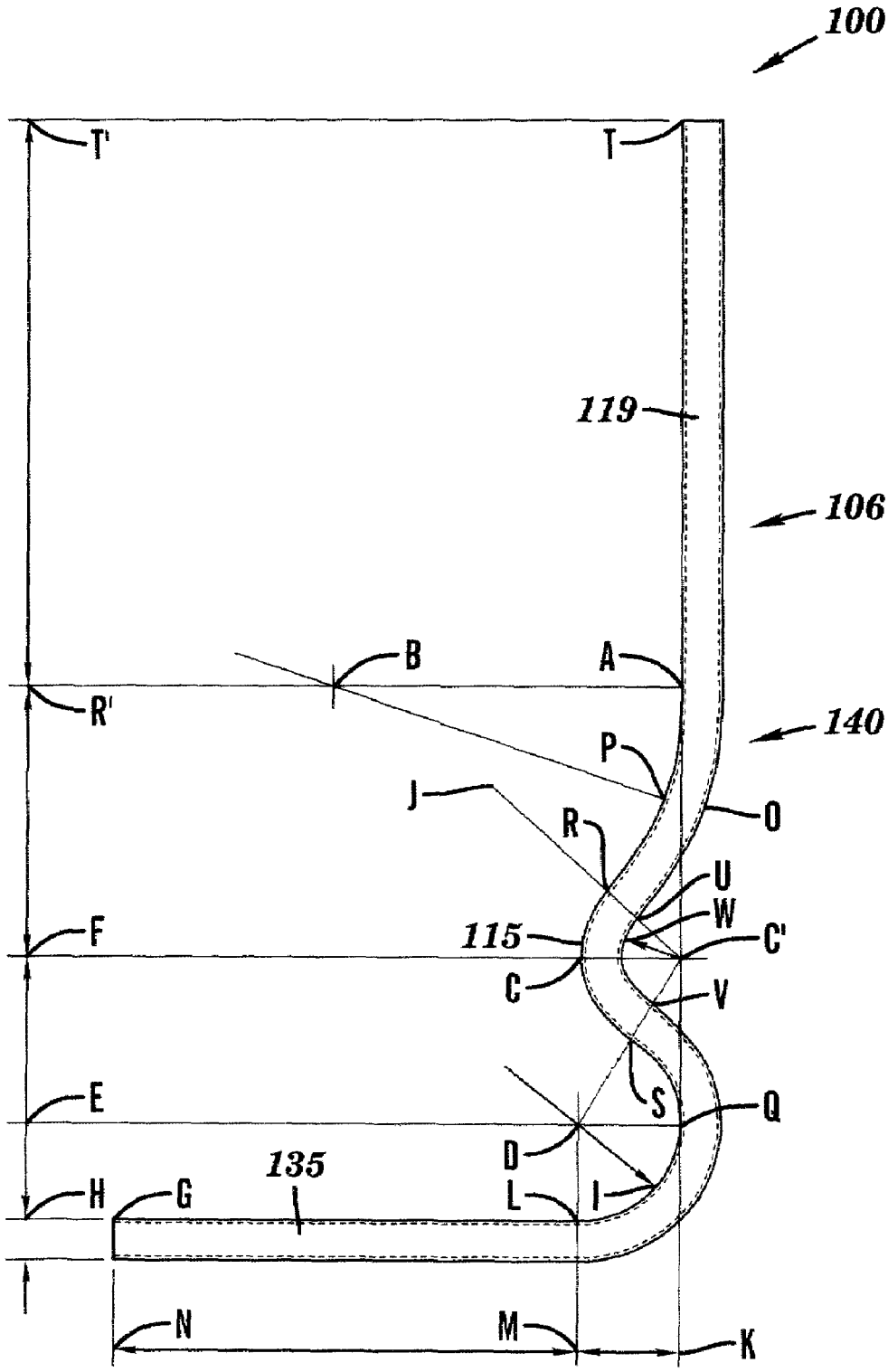
FIG. 4 depicts a longitudinal side view of the chair frame of the orthopedic support, in accordance with embodiments of the present invention.

The at least one layer(s) 101 of the fabric is operationally or operably coupled to the chair frame 106 of the supporting structure 100. The at least one layer(s) 101 of a fabric operationally coupled to the chair frame 106 may be interrupted by funnel opening(s) 116 located under the pressure points of a person's body, so that the person's weight is distributed over the total bearing surface(s) 110 and 120 instead of being localized at the point of contact of the load bearing surface(s) 110, 120 and pressure points such as the ischium, the shoulder blades, tail bone and heels across the whole load bearing surface(s) 110, 120 when the person is sitting or reclining in the chair. The funnel opening(s) 116 may be formed by making a slit in the fabric in the direction of the arrow 50. The fabric may then be stretched to a point before encountering the Young's modulus in a direction of the arrow 53 that is orthogonal to the direction of the wales of the fabric, that run in a direction of the arrow 50, which has the effect of forming an oblong funnel opening(s) 116 whose longitudinal axis is in the direction of the wales of the fabric, i.e. in the direction of the arrow 50. Continued stretching forms circular funnel opening(s) 116. However, the fabric may only be stretched to it's Young's modulus elongation before it becomes plastic or brittle and deforms, or breaks apart. A cross-sectional view of the funnel opening(s) 116, showing an initial layer $L_{n=0}$, successive underlying layers $L_{n=-1}$, $L_{n=-2}$, $L_{n=-3}$, $L_{n=-4}$, $L_{n=-5}$, . . . a bottom layer $L_{n=-i}$, ($L_{n=0}$ . . . $L_{n=-i}$) is depicted in FIG. 2, infra, and described in associated text. Hereinafter "operational coupling", "operably coupled ", or "operably coupling" means stretching the at least one layer(s) 101 of fabric at Q in a plane of the bearing surface 120 that supports the person's buttocks or at 115 in a plane of the bearing surface 120 that supports the lumbar portion of the person's back, of the at least one layer(s) 101 by mechanically and directly attaching the at least one layer(s) 101 to opposite sides of the support members 102, 103, 104, 109, 111, and 112 of the chair frame 106, so that the at least one layer(s) 101 of a fabric is stretched to a maximum percent elongation without at least one layer(s) 101 of a fabric becoming plastic. The body facing load bearing surface 115 of the sigmoidal or S-shaped portion 140 of the chair frame 106, specifically the surface 115 that is oppositely disposed or opposite the arc or curve UV, provides lumbar or lower back support to a person sitting in the structure 100 is depicted in FIGS. 4 and 6, infra, and described in associated text. The points Q or I lie on the surface 115 of the sigmoidal or S-shaped portion of the chair frame 106 between points S and L of the arch or curve SL, as depicted in FIG. 4, infra, and described in associated text.

The Young's Modulus is the presumptive deformation point or plastic point in the stress/strain relationship, i.e., at 80% elongation at 800 lbs., as stated in reference to FIG. 4 in U.S. Pat. No. 4,884,969, authored by the present inventor, hereby incorporated by reference. Hereinafter, "becomes plastic" or "becoming plastic" means the at least one layer(s) 101 of the fabric is no longer elastic, but becomes brittle or deformable so that additional stress, e.g. beyond 800 lbs may result in cracking or breaking or discontinuity in the at least one layer(s) 101 of the fabric. The chair frame 106 may include arm rests 105, and vertical supports 113 and 117 for supporting the armrests 105. The chair frame 106 may include braces 125 for enhancing or strengthening the chair frame for supporting the load that may be preferably from about 30 to about 800 lbs., more preferably from about 100 to about 500 lbs., and most preferably from about 150 lbs. to about 300 lbs. on the bearing surface(s) 110 and 120.

The orthopedic support 100 of the present invention permits a user to experience dramatically reduced, i.e., essentially zero resistance under specific pressure points by positioning the opening(s) 116 in the fabric to lie under their pressure point(s). The opening(s) 116 depicted in FIGS. 1A, 1B, and 2-5 underlie the pressure points created by a typical person in a sitting position, specifically the opening(s) 116 underlie the pair of ischemic protuberances formed by the buttocks of a person in a sitting position. It should be understood that the present invention is not limited to individuals having standard and/or uniform ischemic protuberances. In this regard, the location of the opening(s) 116 in the layer(s) fabric 5 may be customized based on the location of an individual's pressure point(s). Therefore, while the opening(s) 116 depicted in FIGS. 1A, 1B, and 2-5 may provide proper support for a person with standard ischemic protuberance dimensions, individuals with abnormal body shapes, such the elderly and/or those with spinal deformations, may have customized opening(s) 116 to provide a specific support profile. In other embodiments the opening(s) 116 may be a shape other than a slit, for example an arc, a zigzag, a circle, or other non-linear configuration, as dictated by the pressure point(s) profile of a user of the orthopedic support 100.

In an embodiment, the at least one layer(s) ($L_n$), except n=0 and n=−i, advantageously has at least one opening(s) 116 therein, wherein a long axis of the at least one opening(s) 116 is in a wale direction of the fabric and wherein the at least one opening(s) 116 are aligned so that a center of each at least one opening(s) 116 underlies the pressure point of the person.

In an embodiment, the fabric has been stretched from 60 percent to 70 percent of the Young's Modulus.

In an embodiment, the fibers that are chemically different from the polyurethane fiber are selected from the group consisting of polyethylene terephthalate, polyetherimide (PEI), nylon, polyamide, polyester, and combinations thereof.

In an embodiment, the pressure point of the user being supported by the supporting structure 100 includes an ischemic protuberance of the person therein.

In an embodiment, each at least one opening(s) in each at least one layer(s) ($L_n$) of the fabric, except n=0 and n=−i, is aligned on an axial axis of the fabric, and wherein each at least one opening(s) in each successive at least one layer(s) ($L_n$) of the fabric has a successively smaller area as n becomes increasingly negative.

In an embodiment, a shape of the at least one opening(s) is selected from the group consisting of a circle, an ellipse, a slit, a line, a zigzag, a rectangle, an ellipse having a serrated edge, and combinations thereof.

In FIG. 1A, in an advantageous embodiment, operationally coupling the fabric to the oppositely disposed support members 102, 103, 104, 109, 111, and 112 of the chair frame 106 so that the fabric stretches or elongates 78% under a load of 500 lbs provides the bearing surface(s) 110 and 120, thereby effectively distributing the pressure created by the load on the bearing surface(s) 110 and 120 so that the pressure at the ischia or any other pressure point does not exceed preferably from about less than 90 mm (Hg), more preferably from about less than 50 mm (Hg) and most preferably from about less than 10 mm (Hg). Hereinafter 100 mm (Hg) equal to 3 lbs./sq. in. In an embodiment in which the load bearing surface 110, 120 advantageously has funnel opening(s) 116 under the pressure point such as the ischia, the load bearing surface advantageously provides essentially zero resistance to a pressure point of the person, wherein the pressure point of the person exerts preferably from about 10 to about 90 mm (Hg) of pressure, more preferably from 10 to about 50 mm (Hg) of pressure, and most preferably from about 10 to about 30 mm (Hg) of pressure over the opening(s) 116.

Figure 1B:
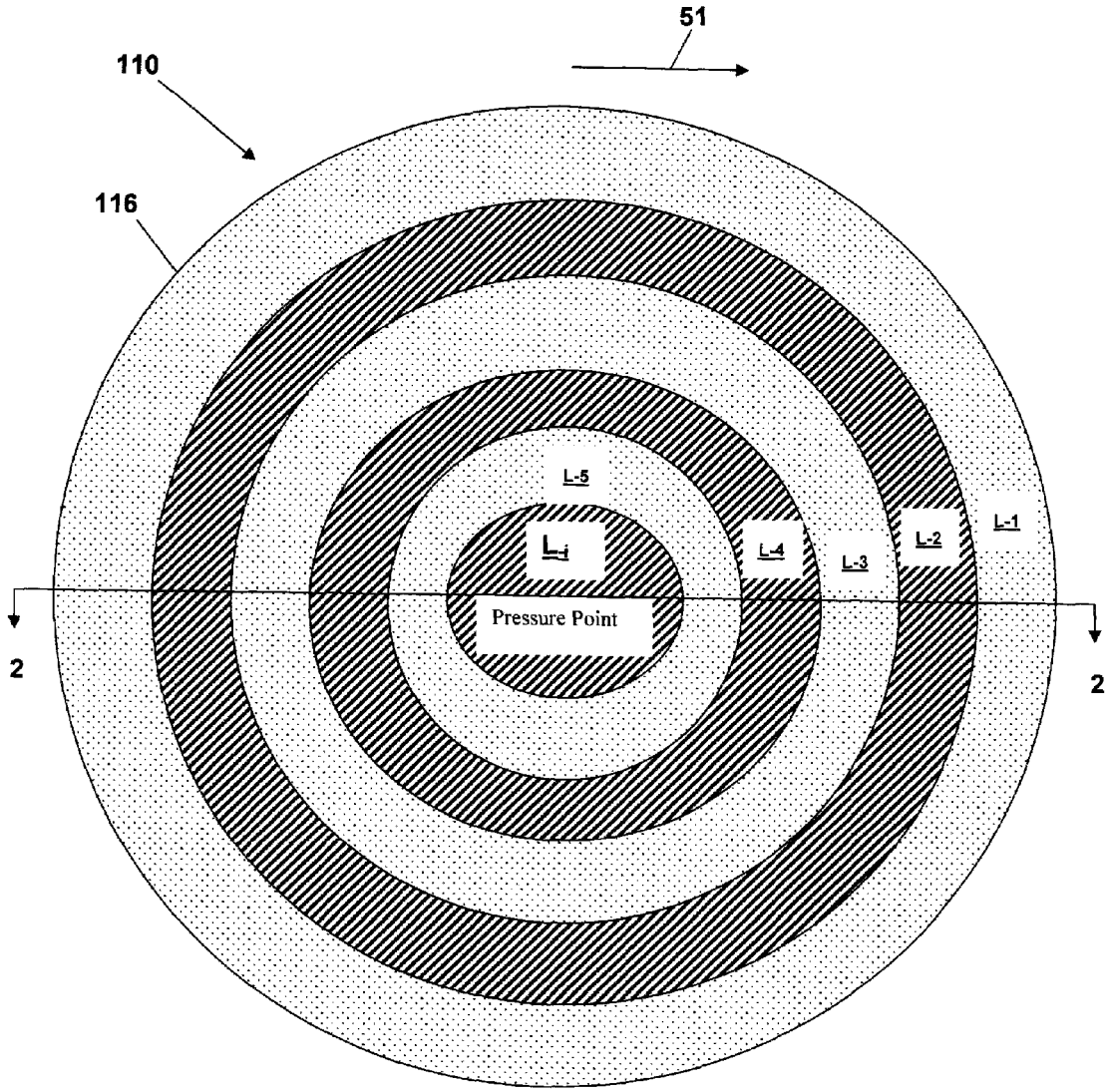
FIG. 1B depicts a top view of the bearing surface of the orthopedic support showing the multiple layers of fabric in the Funnel-Out pattern, in accordance with embodiments of the present invention.

FIG. 1B depicts a top planar view of the funnel opening(s) 116 in load bearing surface 110, before an initial or top layer $L_{n=0}$ has been overlaid on successive underlying layers $L_{n=-1}$, $L_{n=2}$, $L_{n=-3}$, $L_{n=-4}$, $L_{n=-5}$, . . . and a bottom layer $L_{n=-i}$, ($L_{n=0}$ . . . $L_{n=-i}$). The funnel opening(s) 116 in the bottom layer ($L_{n=-i}$), e.g. $L_{n=-6}$ in FIG. 1B has been aligned with the pressure point, i.e. the ischium, of a person, by coinciding the ichium with the center of the funnel opening(s) 116 using any appropriate method of measurement such as pressure sensing array or direct measurements. The fabric may have from 1 to 25 at least one layer(s) 101. The arrow 51 is in the direction of the wales of the fabric and is orthogonal to the direction 53 of stretching the fabric, as shown in FIG. 1A and described herein. The fabric consists essentially of a polyurethane fiber and a fiber that is chemically different from the polyurethane fiber, and wherein the fabric has been stretched less than its Young's modulus.

In FIG. 1B the layers of fabric that form the bearing surface(s) 110 and 120 consist of a top layer ($L_{n=0}$), not shown, a bottom layer ($L_{n=-i}$), and at least one layer $L_{n=-1}$, $L_{n=-2}$, . . . interposed between said top layer ($L_{n=0}$) and said bottom layer ($L_{n=-i}$).

The ability of the bearing surface(s) 110 and 120 to be customized based on the individual user's support needs naturally lends the application of the orthopedic support 100 of the present invention to medical applications such as hospital chairs, wheelchair seats and backs, and for pressure sensitive applications such as those suffering from sores, severe burns, regions of the body recently operated on, and the like.

Figure 1C:
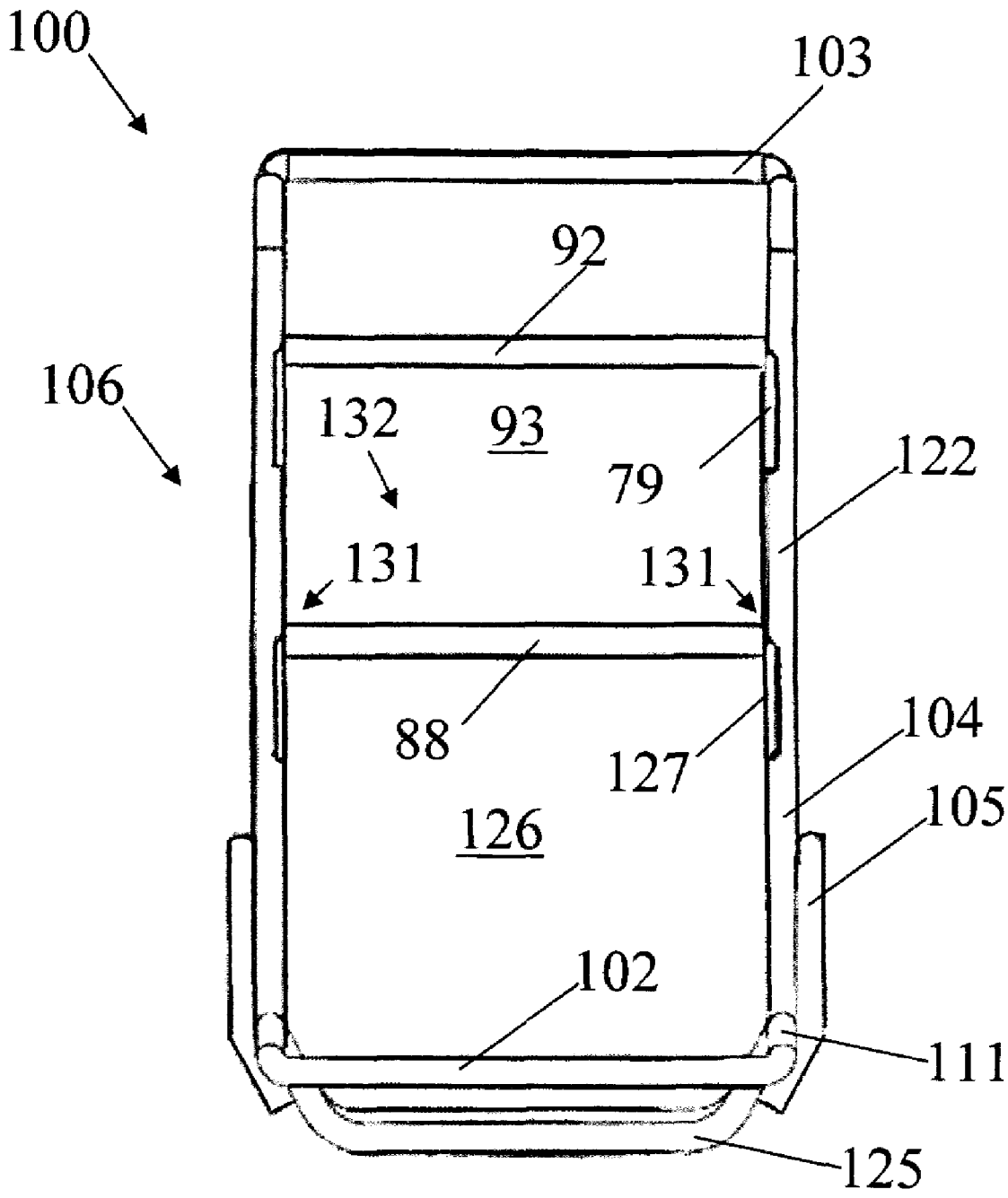
FIG. 1C depicts a bottom isometric of the supporting structure, in accordance with embodiments of the present invention.

FIG. 1C depicts a bottom isometric of the supporting structure 100. FIG. 1C depicts an embodiment in which the chair frame 106 of the structure 100 comprises members 103, 92, 122 of a back and lumbar supporting section 132 and members 88, 104, 111, and 125 of a buttocks and thigh supporting section 133. The support bearing surfaces 126, 92 have been formed by stretching the at least one layer(s) 101 of the fabric between the members 103, 122 of a back and lumbar supporting section 132 and members 104, 111, and 125 of a buttocks and thigh supporting section 133. Cross members 92 and 88 are operably physically and mechanically directly connected to outer members 122 and 104 via brackets 79 and 127 respectively. Under a load of from about a 100 lb. to about a 280 lb. person, the load bearing surfaces 93 and 126 do not contact the cross members 92 and 88 because the load bearing surfaces 93 and 126 have been stretched between the members 103, 92, 122 of a back and lumbar supporting section 132 and members 88, 104, 111, and 125 of a buttocks and thigh supporting section 133 to a point just before the Young's Modulus is reached.

FIG. 1C depicts an embodiment in which the supporting structure 100 may be an orthopedic chair for a wheel chair. By rotating about the hinges 131, the plane of the load bearing surface 93 may be preferably from about −20° to about 90° to the plane of the load bearing surface 126, more preferably from about 0° to about 90° to the plane of the load bearing surface 126, and most preferably from about 20° to about 90° to the plane of the load bearing surface 126.

Figure 3:
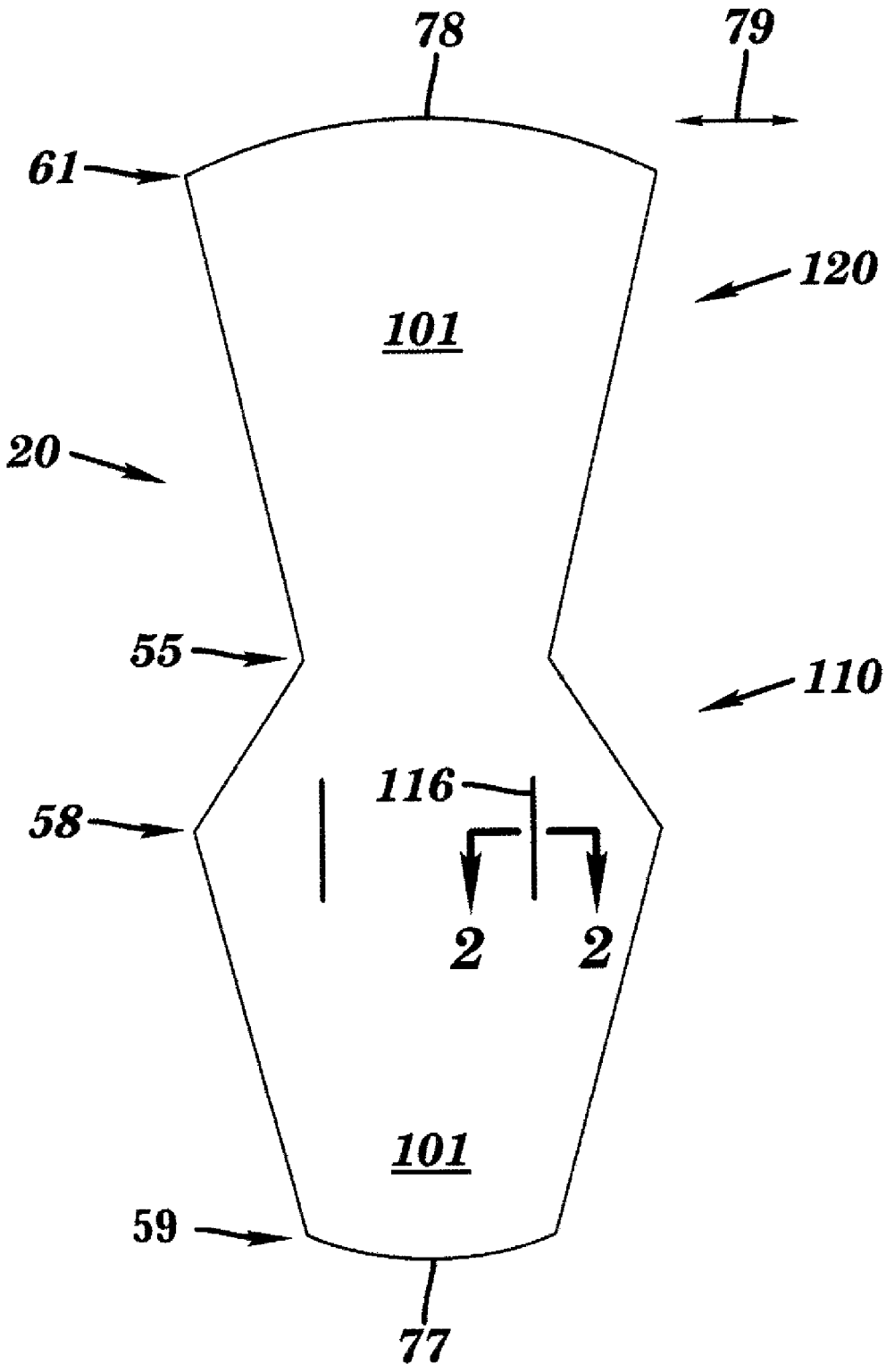
FIG. 3 depicts a top view of the fabric cut to a predetermined pattern prior to stretching, in accordance with embodiments of the present invention.

FIG. 2 depicts a cross sectional view of the funnel opening(s) 116 in the bearing surface(s) 110 and 120 of the orthopedic support 100 showing the at least one layer(s) 101 of fabric when stretched in a direction of arrow 53 onto the chair frame 106 as depicted in FIG. 3, infra and described in associated text. FIG. 2 depicts an embodiment in which seven layers of fabric advantageously form the bearing surface(s) 110 and 120, wherein the top layer ($L_{n=0}$) and the bottom layer ($L_{n=-i}$) of fabric do not have an opening(s) 116 therein, and the layers of fabric ($L_{n=-1\ to\ -5}$) interposed between the top layer ($L_{n=0}$) and the bottom layer ($L_{n=-i}$) of fabric have at least one opening(s) 116 under a pressure point of a user therein. In one embodiment the opening(s) 116 in each successive layer of the at least one layer(s) 101 of fabric are progressively reduced in size, so that the opening(s) 116 the uppermost layer ($L_{n=0}$) has a larger diameter than that of the layer $L_{n=-1}$, and becoming progressively smaller to the bottom most layer ($L_{n=-n}$). The net effect of the above-described placement of opening(s) 116 in the at least one layer(s) 101 of fabric is to provide funnel-like support under a pressure point of a user, such that the user experiences reduced or effectively zero resistance under the pressure point(s). As mentioned previously, the pressure point may represent the ischemic protuberances of a user, or other pressure point(s) based on the individual user's specific criteria. While FIGS. 1A and 2 disclose a Funnel-Out design, the bearing surface(s) 110 and 120 of the orthopedic support 100 of the present invention is not limited to this design. Alternative patterns of opening(s) 116 in the fabric may have the successive underlying layers increase in diameter.

In forming the bearing surface(s) 110 and 120, the fabric has been stretched to the point just before encountering the Young's Modulus, and a point thereafter at which large increases in weight, applied to the fabric or on the fabric, does not cause any significant extension of the fabric without deformation. This allows differing weights of people's bodies to experience the same degree of solid support and the distribution of pressure at the pressure points on the bearing surface(s) 110 and 120 is achieved to be preferably less than from about less than 90 mm (Hg), more preferably from about less than 50 mm (Hg) and most preferably from about less than 10 mm (Hg).

In an embodiment, a method of making a chair having a load bearing surface comprises the steps of: providing a frame 106 for stretching an at least one layer(s) ($L_n$). In the method, n=0, −1, −2, . . . −i. In the method, n=0 represents the layer ($L_n$) of the load bearing surface that contacts the load. In the method, n=−1, −2, . . . −i represents successive underlying at least one layer(s) ($L_n$) of the load bearing surface. In the method, n=−i represents a bottom underlying layer ($L_n$) of the load bearing surface. The fabric consists essentially of a polyurethane fiber and a fiber that is chemically different from the polyurethane fiber, such as polyester, nylon and polyamide. In the method, cutting the at least three layers ($L_n$) to a predetermined pattern results in funnel opening(s) 116. In the method, stretching the at least three layers ($L_n$) of fabric between members of the frame 106 results in the fabric being stretched to the point just before encountering the Young's Modulus.

In the method of making the chair, the at least one opening(s) 116 in the at least one layer(s) ($L_n$) may be made in the fabric having a load bearing surface 110, 120, except no at least one opening(s) 116 is made in n=0 and n=−i layers, i.e. in the top and bottom at least one layer(s) $L_n$. In the method, a long axis of the at least one opening(s) 116 is in a wale direction of the fabric. In the method of making the chair, the at least one opening(s) are aligned so that a center of each at least one opening(s) 116 underlies a pressure point of the person therein.

In the method for making the chair, the fabric consists essentially of a polyurethane fiber and a fiber that is chemically different from the polyurethane fiber. In the method, the opening(s) 116 is made by cutting the at least three layers ($L_n$) to a predetermined pattern. In the method, the at least three layers ($L_n$) of fabric are stretched so that the fabric has been stretched to the point just before encountering the Young's Modulus.

The opening(s) 116 in the at least one layer(s) 101 of the fabric are present only in layer(s) 101 of fabric interposed between the top layer ($L_{n=0}$) and the bottom layer ($L_{-i}$); that is, the top layer ($L_{n=0}$) and the bottom layer ($L_{-i}$) of fabric do not have an opening(s) 116. In a preferred embodiment, the opening(s) 116 shown in FIG. 2 is an oblong slit where the long diameter is in the wale direction of the fabric, which becomes a concentric shape when the fabric is stretched onto the chair frame 106. Hereinafter, the term "wale" means a column of knitted loops along the length of a knitted fabric. Hereinafter, the term "course" refers to a horizontal row of knitted loops. On a Lee-type chair frame a new course was created on each cycle of the thread being laid and sinkers moved. In hand knitting a course is completed when the fabric has been transferred from one needle to another.

FIG. 3 depicts a top plan view of the at least one layer(s) 101 of fabric cut to a predetermined pattern 20 having funnel opening(s) 116 located along a line between points 54 and 52 so that the funnel opening(s) 116 are located under the pressure points of a person's body, so that the person's weight is distributed over the total bearing surface(s) 110 and 120 when the predetermined pattern 20 is operationally coupled to the chair frame 106. The cut in the fabric forms a slit along a vertical axis of the pattern 20. The funnel opening(s) 116 become oblong and have a long axis along the longitudinal axis of the pattern 20 (in the direction of the wales of the fabric) when the fabric is stretched at points 54 and 52 in the direction of the chair frame 106 (not shown), as depicted by the two headed arrow 79. The location of the opening(s) 116 may be determined by measuring the corresponding pressure points of the person who will be supported by the orthopedic structure 100 and cutting the opening(s) 116 in the fabric so the opening(s) 116 will underlie the pressure points when the fabric is operationally coupled to the chair frame 106. The curvature of edges 77 and 78 is determined by trial and error so that the desired straight edges 107 and 57 may be achieved as shown in FIG. 1A and described herein.

The pattern 20 of the fabric depicted in FIG. 3 further comprises a narrowed waist 55 immediately behind the region 58 on which the user applies their ischemic protuberances over opening(s) 116 upon sitting. FIG. 3 depicts a top view of the opening(s) 116 that are depicted in cross section in FIG. 2. The narrowed portion of the waist 55 causes that region of the fabric 10 to be stretched to a greater extent than other regions of the fabric 10. The increased stretching in the waist 55 thereby provides increased support to the lumbar region of the user of the orthopedic structure 100. In like manner, stretching the distal portion 61 provides increased support to the head of the user. In like manner, stretching the distal portion 59 provides increased support to the knee of the user.

In an embodiment, a method of making a fabric having a load bearing surface, comprises the steps of: providing at least one layer(s) ($L_n$) consisting essentially of a polyurethane fiber and a fiber that is chemically different from the polyurethane fiber, wherein n=0, −1, −2, . . . −i, wherein n=0 represents the layer ($L_n$) of the load bearing surface that contacts the user. In the method of making the fabric, n=−1, −2, . . . −i represents successive underlying at least one layer(s) ($L_n$) of the load bearing surface. In the method for making the fabric, n=−i represents a bottom underlying at least one layer ($L_n$) of the load bearing surface(s) 110, 120, wherein the at least one layer(s) ($L_n$), except n=0 and n=−i has at least one opening(s) 116, wherein a long axis of the at least one opening(s) 116 is in a wale direction of the fabric, wherein the at least one opening(s) 116 are aligned so that a center of each at least one opening(s) 116 underlies a pressure point of the user, depicted in FIG. 1B and described in associated text, herein.

FIG. 4 depicts a longitudinal cross-sectional view of the structure 100, comprising the chair frame 106. The chair frame 106 has an upper-back supporting portion 119, a sigmoidal or S-shaped portion 140, and a buttocks and thigh supporting portion 135. The upper-back supporting portion 119 and the buttocks and thigh supporting portion 135 may be a straight piece of polyvinylchloride (PVC), aluminum, stainless steel piping or the like, having a cylindrical outer diameter from about 0.25 in. to about 1.5 in. A length of the upper-back supporting portion 119 from a distal end T to a proximal point A is about 14.64 in.±3.66 in., so that the upper-back supporting portion 119 includes a length from about 10.98 in. to about 18.30 in. Hereinafter, "distal" means a point or an end of the chair frame 106 that is farthest away from a center C of the sigmoidal or S-shaped portion 140 of the chair frame 106. Hereinafter, "proximal" means a point or an end of the chair frame 106 that is closest to the center C of the sigmoidal or S-shaped portion 140 of the chair frame 106. A length of the buttocks and thigh supporting portion 135 from a distal end G to a proximal point L is about 11.36 in±2.84 in., so that the buttocks-supporting portion 135 includes a length from about 8.52 in. to about 14.20 in.

The sigmoidal or S-shaped portion 140 lies between the proximal point A of the chair frame 106 and the proximal point L of the buttocks-supporting portion 135 of the chair frame 106 and has a body facing supporting surface 115 and a rear facing supporting surface 117. The body facing supporting surface 115 of the sigmoidal or S-shaped portion 140 of the chair frame 106, specifically the surface 115 that is oppositely disposed or opposite the arc or curve UV, provides lumbar or lower back support to a person sitting in the structure 100.

The sigmoidal or S-shape portion 140 of the chair frame 106 may be defined by two concave arcs or curves and a convex arc or curve: a first concave arc or curve AR between points A and R on the surface 115; a convex arc or curve RS between points R and S on the surface 117; and a third concave arc or curve SL between points S and L on the surface 115.

A length $L_{arc}$ of the arcs or curves AR, RS and SL is defined by equation (1):

$$L_{arc}=2\pi r\times(\theta_{arc}/360°) \quad (1)$$

wherein r is a length in inches from a location on either the sigmoidal or S-shape of the lumbar or lower back supporting surface 115 or 117 of the chair frame 106 to a reference point, the location of which is in the plane of the cross sectional view of the chair frame 106 depicted in FIG. 1B and described in associated text. The $\theta_{arc}$ is an angle about the reference point that delimits the points A, R, R, S and S, L for each arc or curve respectively, when the arc or curve is viewed from the reference point. Values of $L_{arc}$, r, and $\theta_{arc}$ of the arcs or curves are listed in Table 1.

TABLE 1

$L_{arc}$, r, and $\theta_{arc}$ of the arcs or curves in the sigmoidal or S-shaped portion of the chair frame 106, in accordance with equation 1.

| Arch or Curve | $L_{arc}$ (inches) | r (inches) | $\theta_{arc}$ (degrees) |
|---|---|---|---|
| AR | 3.71-10.30 | 8.59 +/− 25% | $44^0$ +/− 25% |
| SR | 1.52-4.21 | 1.5 +/− 25% | 103 +/− 25% |
| SL | 3.66-10.16 | 2.5 +/− 25% | 149 +/− 25% |

The sigmoidal or S-shaped portion 140 of the chair frame 106 may be constructed of polyvinylchloride (PVC) pipe, aluminum pipe or the like, having an outer diameter from about 0.25 in. to about 1.5 in.

The reference point B for the arc or curve AR lies on a line R'A between points R' and A, said point A being the distal point on the surface 115 of the sigmoidal or S-shaped portion of the chair frame 106, and said line R'A being parallel to a surface 121 of the buttocks-supporting portion 135 of the chair frame 106. The reference point B lies at a point from about 8.59 in±2.15 in. from the point P, wherein the point P lies on the surface 115 between points A and R of the arch or curve AR.

The reference point C' for the arc or curve UV lies on a line FCC' connecting points F, C and C', said point C' being oppositely disposed from the point C on the surface 115 of the sigmoidal or S-shaped portion of the chair frame 106, said line UV being also parallel to both the line R'A and the surface 121 of the buttocks-supporting portion 135 of the chair frame 106. The reference point C' lies at a point from about 1.50 in±0.38 in. from the point W, wherein the point W lies on the surface O between points U and V of the arch or curve UV.

The reference point C lies on the surface 115 of the sigmoidal or S-shaped portion 140 of the chair frame 106 at a center point of the convex arc or curve RS between points R and S on the surface 115.

The reference point D for the arc or curve SL lies on a line EDQ connecting points E, D and Q, said point Q being on the surface 115 of the sigmoidal or S-shaped portion of the chair frame 106, said line SL being also parallel to both the line R'A and the surface 121 of the buttocks-supporting portion 135 of the chair frame 106. The reference point D lies at a point from about 2.50 in±0.63 in. from the point Q or I, wherein the points Q or I lie on the surface 115 of the sigmoidal or S-shaped portion of the chair frame 106 between points S and L of the arch or curve SL.

FIG. 5 depicts the longitudinal cross-sectional view of the structure 100 as shown in FIG. 4, further comprising a sagittal cross section 71 or sagittal plane of a person, including the lumbar portion 74 of a person's back, i.e. between the points 70 and 72, the buttocks portion 76 between points 72 and 73 and the thigh portion 77, between the knee 75 and point 73. Hereinafter, "sagittal" planes are vertical planes passing through the body parallel to the median plane, dividing it into right and left portions. In FIG. 5, the points P, R, S, I and G correspond to the same reference numbers or letters as in FIG. 4. The orthopedic structure 100 improves the sitting posture of a person by providing higher tension under the knee 75 and at the lumbar portion 74, so that the knee 75 is raised to a higher position than the buttocks portion 76, which relieves the pressure on the lumbar portion 74. In one embodiment, in the sitting position, when a person's knee 75 is raised higher than the buttocks portion 76, pressure on the lumbar portion 74 is relieved, The orthopedic structure 100 relieves pressure on the lumbar portion 74 when the fabric of the orthopedic structure 100 is stretched to a higher elongation so that tension of the fabric is increased under the knee 75 and support is provided at the lumbar portion 74, e.g. specifically the surface 115 that is oppositely disposed or opposite the arc or curve UV, provides lumbar or lower back support to a person sitting in the structure 100.

FIG. 6 depicts the longitudinal cross-sectional view of the structure 100 as shown in FIG. 4, comprising a person 88 being supported by the at least one layer(s) 101 of the fabric of the structure 100. The at least one layer(s) 101 of the fabric of the structure 100 consists essentially of a soft, flexible elastic fabric, knitted with polyurethane and another polymer fiber such as polyester or polyamide. Lycra® is a registered trademark used for DuPont's polyurethane fiber. The person 88 and the chair frame 106 in FIG. 6 depict a sagittal cross section 81 or sagittal plane, illustrating the at least one layer(s) 101 supporting the person, including the back 29 of the head 90, the lumbar portion 84 of the person's back, i.e. between the points 80 and 82 of the person 88, the buttocks portion 86 between points 82 and 83 of the person 88, and the thigh portion 87, between the knee 85 and point 83 of the person 88. In FIG. 6, the points 78, 106, 115, R, S, L, 135 and G correspond to the same reference numbers or letters as in FIGS. 1A and 4. The orthopedic structure 100 improves the sitting posture of the person 88 by providing higher tension under the knee 85 and at the lumbar portion 84, so that the knee 85 is raised to a higher position than the buttocks portion 86, which relieves the pressure on the lumbar portion 84. In one embodiment, in the sitting position, when the knee 85 is raised higher than the buttocks portion 86, pressure on the lumbar portion 84 is relieved. The orthopedic structure 100 relieves pressure on the lumbar portion 84 when the at least one layer(s) 101 of the fabric of the orthopedic structure 100 is stretched to a higher elongation so that tension of the fabric is increased under the knee 85 and support is provided at the lumbar portion 84, e.g. specifically the surface 115 that is oppositely disposed or opposite the arc or curve UV, as depicted in FIGS. 1A and 4 and described in associated text, provides lumbar or lower back support to the person 88 sitting in the structure 100.

EXAMPLE 1

Referring to FIGS. 5 and 6, the orthopedic structure 100 improved the sitting posture of a person 77, depicted in FIG. 5, and a person 81 depicted in FIG. 6, by providing higher tension under the knee 75 depicted in FIG. 5 and 85 depicted in FIG. 6 and at the lumbar portion 74, depicted in FIG. 5, and 84 depicted in FIG. 6, so that the knee 75, 85 is raised to a higher position than the buttocks portion 76, depicted in FIG. 5, and 86, depicted in FIG. 6, which relieves the pressure on the lumbar portion 74, 84.

Referring to FIGS. 3 and 5 or to FIGS. 3 and 6, stretching the distal portion 61 of the pattern 20 between the support members 102, 103, 104, 109, 111, and 112 of the chair frame 106 provides increased support for the head 90 where the back 29 of the head 90 comes in direct physical contact with the bearing surface 120 of the at least one layer(s) 101 of the fabric of the structure 100, as viewed in FIGS. 3 and 6. In like manner, stretching the waist 55 of the pattern 20 between the support members 102, 103, 104, 109, 111, and 112 of the chair frame 106 provides increased support for the lumbar position 74 as viewed in FIG. 5, and 84 as viewed in FIG. 6. In like manner, stretching the region 58 of the pattern 20 between the support members 102, 103, 104, 109, 111, and 112 of the chair frame 106 on which the user 88 applies their ischemic protuberances over opening(s) 116 provides increased support for the user's buttocks 76 in FIG. 5 and 86 in FIG. 6 upon sitting on position I in FIG. 5 and 83 in FIG. 6. In like manner, stretching the distal portion 59 of the pattern 20 between the support structures 102, 103, 104, 109, 111, and 112 of the chair frame 106 provides increased support to the knee 75 as viewed in FIG. 5 and to the knee 85 at a position 89 at which the knee 85 bends as viewed in FIG. 6.

In one embodiment, the sitting posture of a 100 lb.-280 lb. person 77, 81, depicted in FIGS. 5 and 6 was advantageously improved by stretching the waist 55 and the distal portion 59 of the pattern 20 of the load bearing surface 120 from 70% to less than about 80% elongation between the support members 102, 103, 104, 109, 111, and 112 of the chair frame 106, wherein both the waist 55 and the distal portion 59 have an 8 in. length and are depicted in FIG. 3. In this embodiment said stretching the waist 55 of the pattern 20 of the load bearing surface 120 resulted in a 10-20 lbs/sq. in. pressure distribution on the load bearing surface 120 at the lumbar position 84 of the 100 to 280 lb. person, as viewed in FIGS. 5 and 6. Said stretching the distal portion 59 of the pattern 20 resulted in a 30-60 lbs/sq. in. pressure distribution on the bearing surface 110 at the knee position 89 at which the knee 85 bends from the 100 to 280 lb. person, as viewed in FIGS. 5 and 6. The orthopedic structure 100 depicted in FIGS. 5 and 6 improved the sitting posture of the person 77 depicted in FIG. 5, and 81 depicted in FIG. 6, by providing higher tension under the knee 75, 85 and at the lumbar portion 74, 84 so that the knee 75, 85 is raised to a higher position relative to the buttocks portion 76, 86, which relieves the pressure on the lumbar portion 74, 86.

EXAMPLE 2

Figure 7A:
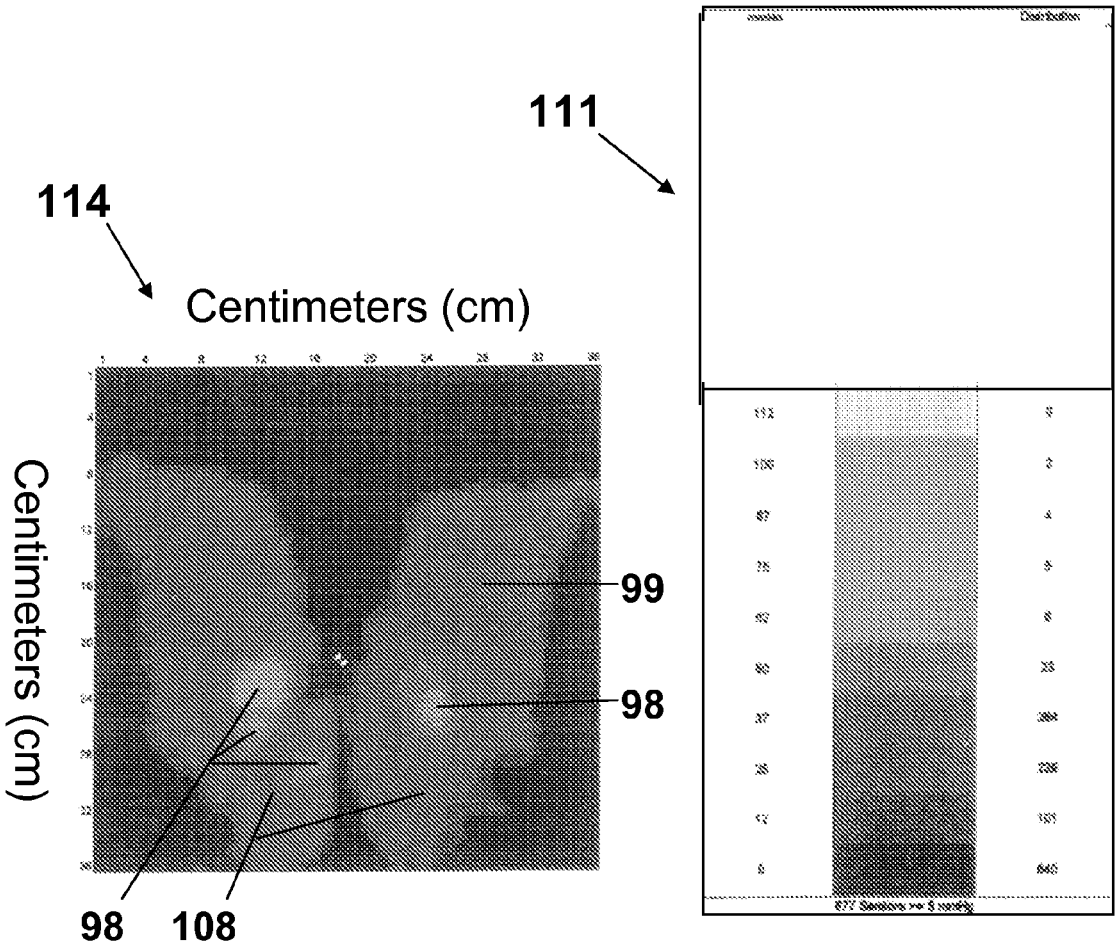
FIG. 7A depicts a pressure map of a bearing surface of the supporting structure, in accordance with embodiments of the present invention.

FIG. 7A depicts a pressure map 114 of the pressure distribution across the bearing surface(s) 110, 120 produced by a person's buttocks 99 in a sitting position upon the support structure 100. The pressure across the bearing surface(s) 110, 120 may be measured by an XSENSOR Pressure Mapping System, available from ROHO, Inc., 100 N. Florida Ave. Belleville, Ill. 62221. The table 111 correlates a shade of grey color coding with the pressure (in mmHg) and pressure distribution measured at the load bearing surface 110, 120. The pressure map 114 shows the pressure distribution is essentially uniformly distributed from about 40 to about 50 lbs./sq in. across the bearing surface 110, based on the correspondence of the grey color that corresponds to the same pressure in table 111 with the grey color of the buttocks and leg portion 99 of the map 114. The higher pressures indicated at pressure point(s) 98 are artifacts or interferences because the load bearing surface(s) 110, 120 under the person's buttocks 99 have bottomed out on a support member of the structure 100, thereby preventing the load bearing surface(s) 110, 120 from properly elongating to the point just before reaching the Young's modulus, resulting in a distortedly high readout of pressure from the pressure map 114. Likewise, the pressure map 114 shows the pressure distribution is essentially uniformly distributed from about 40 to about 50 lbs./sq in. across the ischia 108.

In FIG. 7A, the fabric has not yet been stretched to its limit, which is the Young's Modulus. That limit, in this case, would be about 80% at 800 lbs. Since, during manufacturing, the fabric may be stretched to 60-75% for comfort level, it can be seen that 20-5% stretchability remains under various loads, preferably in the range of about 50 to about 800 lbs., more preferably between about 100 to about 500 lbs. and most preferably from about 150 lbs. to about 300 lbs.; at which point the distribution of pressure at the pressure points is achieved to be preferably less than from about less than 90 mm (Hg), more preferably from about less than 50 mm (Hg) and most preferably from about less than 10 mm (Hg).

EXAMPLE 3

Figure 7B:
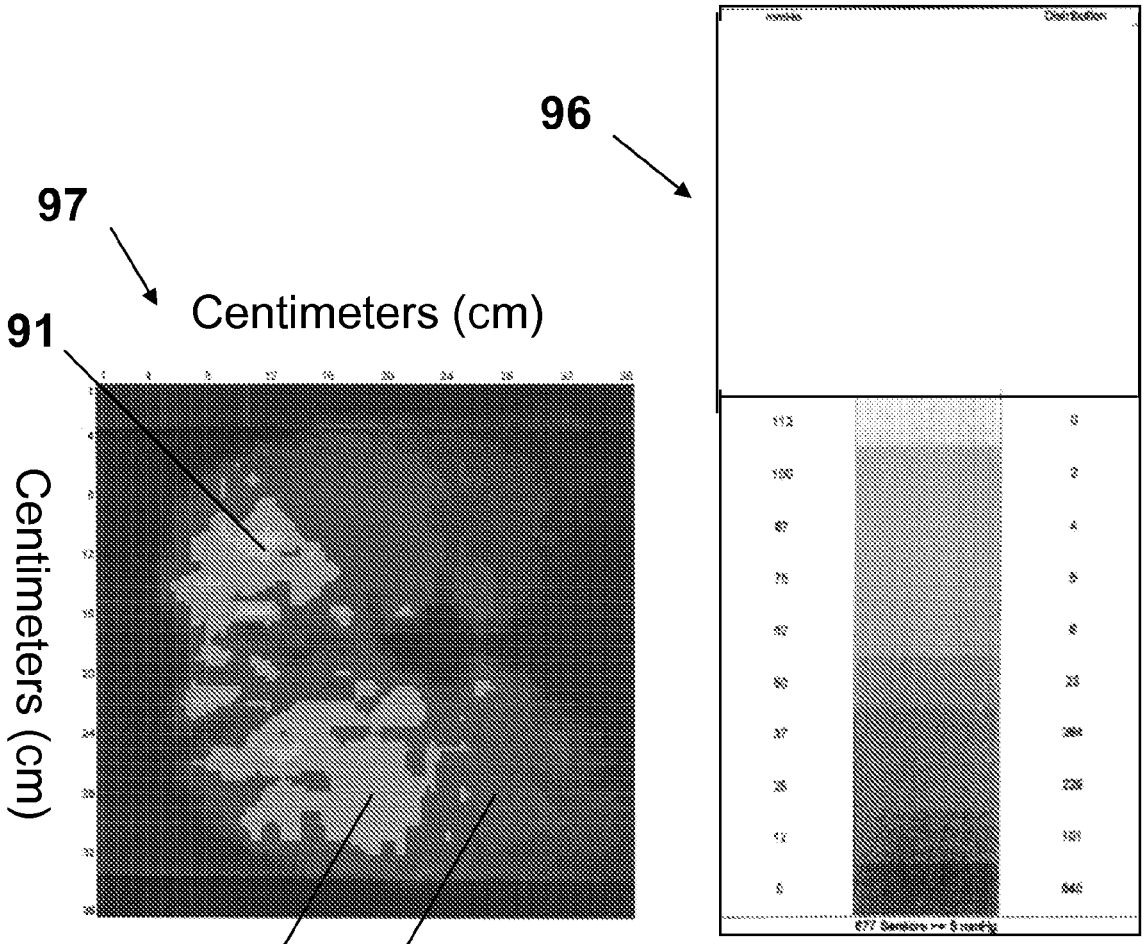
FIG. 7B depicts a pressure map of a bearing surface of a typical deep contour cushion, in accordance with embodiments of the present invention.

FIG. 7B depicts a pressure map 97 of the pressure distribution across the bearing surface(s) 110, 120 produced by a person's buttocks 94 in a sitting position upon a typical deep contour cushion. The pressure across the bearing surface(s) 110, 120 were measured by the XSENSOR Pressure Mapping System. The table 96 correlates a shade of grey color coding with the pressure (in mmHg) and pressure distribution measured at the load bearing surface 110, 120. The pressure map 97 shows the pressure distribution varies in a non-uniform distribution from about 40 to about 50 lbs./sq in. to about 112 lbs./sq. in. across the bearing surface 110, based on the correspondence of the grey color that corresponds to the same pressures in table 96 with the grey color of the buttocks and leg portion 94 of the map 97. The higher pressures indicated at pressure point(s) 95 are artifacts or interferences because the load bearing surface(s) 110, 120 under the person's buttocks 99 have bottomed out on a support member of the structure 100, thereby preventing the load bearing surface(s) 110, 120 from properly elongating to the point just before reaching the Young's modulus, resulting in a distortedly high readout of pressure from the pressure map 97. Likewise, the pressure map 97 shows the pressure at ischia 91 is non-uniformly distributed and higher than the pressure from the map 114 in Example 2, supra, i.e., from about 60 to about 112 lbs./sq. in. non-uniformly distributed from about 40 to about 50 lbs./sq in. across the ischia 108.

The invention in its broader aspects is not limited to a singular preferred embodiment shown herein but may be practiced in different embodiments conceiving of differing fibers, fabrics, and arrangement and manipulations thereof. The invention in such broader aspects is limited only by the claims hereinafter made.

I claim:

1. An orthopedic chair, comprising:

a chair frame having support members;

a fabric stretched between the support members of the chair frame having a load bearing surface for supporting a person in a sitting position, wherein the fabric has greater than or equal to one layer(s) ($L_n$).

wherein n=0, −1, −2, . . . −i, wherein n=0 represents the greater than or equal to one layer(s) ($L_n$) of the load bearing surface that contacts the load, wherein n=−1, −2, . . . −i, represents successive underlying greater than or equal to one layer(s) ($L_n$) of the load bearing surface, wherein n=−i, represents a bottom underlying greater than or equal to one layer(s) ($L_n$) of the load bearing surface, wherein the fabric consists essentially of a polyurethane fiber and a fiber that is chemically different from the polyurethane fiber, and wherein the fabric has been stretched between members of the chair frame so that the fabric's percent elongation approaches but is less than the percent elongation for the Young's Modulus.

2. The apparatus of claim 1, wherein the greater than or equal to one layer(s) ($L_n$), except n=0 and n=−i, has one greater than or equal to one opening(s) therein, wherein a long axis of the greater than or equal to one opening(s) is in a wale direction of the fabric and wherein the greater than or equal to one opening(s) are aligned so that a center of each greater than or equal to one opening(s) underlies the pressure point of the person.

3. The apparatus of claim 2, wherein each greater than or equal to one opening(s) in each greater than or equal to one layer(s) ($L_n$) of the fabric, except n=0 and n=−i, is aligned on an axial axis of the fabric, and wherein each greater than or equal to one opening(s) in each successive greater than or equal to one layer(s) ($L_n$) of the fabric has a successively smaller area as n becomes increasingly negative.

4. The apparatus of claim 2, wherein a shape of the greater than or equal to one opening(s) is selected from the group consisting of a circle, an ellipse, a slit, a line, a zigzag, a rectangle, an ellipse having a serrated edge, and combinations thereof.

5. The apparatus of claim 2, wherein the load bearing surface provides essentially zero resistance to a pressure point of the person, wherein the pressure point of the person exerts from about 10 to about 90 mm (Hg) of pressure.

6. The apparatus of claim 5, wherein the pressure point includes an ischemic protuberance of the person therein.

7. The apparatus of claim 1, wherein a sitting posture of a person is improved by stretching a waist and a distal portion of a pattern of the load bearing surface from about 70% to about less than 80% elongation between support members of the chair frame.

8. The apparatus of claim 1, wherein the fabric has been stretched from 60 percent to 70 percent of the Young's Modulus.

9. The apparatus of claim 1, wherein the fibers that are chemically different from the polyurethane fiber are selected from the group consisting of polyethylene terephthalate, polyetherimide (PEI), nylon, polyamide, polyester, and combinations thereof.

10. An apparatus for supporting a person, comprising:

a pattern made of a fabric having a load bearing surface formed by stretching the fabric between members of a chair frame, comprising a supporting portion for a person's head, a supporting portion for the person's waist, a supporting portion for the person's buttocks, and a supporting portion for a person's knee, wherein the supporting portions of the pattern have been stretched between support members of the chair frame, wherein the knee portion is raised to a higher position than the buttocks portion, wherein the fabric has greater than or equal to one layer(s) ($L_n$), wherein n=0, −1, −2, . . . −i, wherein n=0 represents the greater than or equal to one layer(s) ($L_n$) of the load bearing surface that contacts the load, wherein n=−1, −2, . . . −i, represents successive underlying greater than or equal to one layer(s) ($L_n$) of the load bearing surface, wherein the fabric has been stretched so that the fabric's percent elongation approaches but is less than the percent elongation for the Young's Modulus.

11. The apparatus of claim 10, wherein stretching a waist of a pattern of the load bearing surface resulted in a 10-20 lbs/sq. in. pressure distribution on the load bearing surface at a lumbar position of a 100 to 250 lb. person.

12. The apparatus of claim 10, wherein the load bearing surface provides essentially zero resistance to a pressure point of the person, wherein the pressure point of the person exerts from about 10 to about 90 mm Hg of pressure.

13. The apparatus of claim 12, wherein the pressure point includes an ischemic protuberance of the user therein.

14. The apparatus of claim 10, wherein the fabric has been stretched from 60 percent to 70 percent of the Young's Modulus.

15. The apparatus of claim 10, wherein the fibers that are chemically different from the polyurethane fiber are selected from the group consisting of polyethylene terephthalate, polyethyletherimide (PEI), nylon, polyamide, polyester, and combinations thereof.

16. The apparatus of claim 10, wherein the greater than or equal to one layer(s) ($L_n$) of the fabric, except n=0 and n=−i, has greater than or equal to one opening(s) therein, and wherein the greater than or equal to one opening(s) are aligned so that a center of each greater than or equal to one opening(s) underlies the pressure point of the person.

17. The apparatus of claim 10, wherein each of the greater than or equal to one opening(s) in each greater than or equal to one layer(s) ($L_n$) of the fabric, except n=0 and n=−i, is aligned on an axial axis of the fabric, and wherein each of the greater than or equal to one opening(s) in each successive greater than or equal to one layer(s) ($L_n$) of the fabric has a successively smaller area as n becomes increasingly negative.

18. The apparatus of claim 10, wherein the greater than or equal to one layer(s) ($L_n$) of the fabric, except n=0 and n=−i, has greater than or equal to one opening(s) therein, wherein a long axis of the greater than or equal to one opening(s) is in a wale direction of the fabric and wherein the greater than or equal to one opening(s) are aligned so that a center of each greater than or equal to one opening(s) underlies the pressure point of the person.

19. The apparatus of claim 18, wherein a shape of the greater than or equal to one opening(s) is selected from the group consisting of a circle, an ellipse, a slit, a line, a zigzag, a rectangle, an ellipse having a serrated edge, and combinations thereof.

20. An apparatus for supporting a person, comprising:

a load bearing surface formed by stretching a fabric between support members of a chair frame, wherein the surface has greater than or equal to one opening(s) therein, wherein a long axis of the greater than or equal to one opening(s) is in a wale direction of the fabric and wherein the greater than or equal to one opening(s) are aligned so that a center of each greater than or equal to one opening(s) underlies a pressure point of the person.

21. The apparatus of claim 20, comprising:

the load bearing surface being adapted to provide an improved sitting posture; and a waist and a distal portion of a pattern of the load bearing surface, wherein the load bearing surface has been stretched greater than 70% but not exceeding 80% elongation between support members of the chair frame.

22. An apparatus having a load bearing surface, comprising:

a chair frame;

a fabric stretched across the chair frame, having greater than or equal to layer(s) ($L_n$), wherein n=0, −1, −2, . . . −i, wherein n=0 represents the greater than or equal to one layer(s) ($L_n$) of the load bearing surface that contacts the load, wherein n=−1, −2, . . . −i, represents successive underlying greater than or equal to one layer(s) ($L_n$) of the load bearing surface, wherein the fabric consists essentially of a polyurethane fiber and a fiber that is chemically different from the polyurethane fiber, wherein the fabric has been stretched between members of the chair frame so that the fabric's percent elongation approaches but is less than the percent elongation for the Young's Modulus, wherein the greater than or equal to one layer(s) ($L_n$), except n=0 and n=−i, has greater than or equal to one opening(s) therein, and wherein the greater than or equal to one opening(s) are aligned so that a center of each greater than or equal to one opening(s) underlies a pressure point of a person.

23. The apparatus of claim 22, wherein the pressure point includes an ischemic protuberance of the person therein.

24. An apparatus having a load bearing surface, comprising:

a chair frame;

a stretched fabric having greater than or equal to one layer(s) ($L_n$), wherein n=0, −1, −2, . . . −i, wherein n=0 represents the greater than or equal to one layer(s) ($L_n$) of the load bearing surface that contacts the load, wherein n=−1, −2, . . . −i, represents successive underlying greater than or equal to one layer(s) ($L_n$) of the load bearing surface, wherein the fabric consists essentially of a polyurethane fiber and a fiber that is chemically different from the polyurethane fiber, wherein the fabric has been stretched between members of the chair frame so that the fabric's percent elongation approaches but is less than the percent elongation for the Young's Modulus wherein the load bearing surface provides essentially zero resistance to a pressure point of the person, wherein the pressure point of the person exerts from about 10 to about 90 mm (Hg) of pressure.

25. An apparatus having a load bearing surface, comprising:

a chair frame;

a stretched fabric having greater than or equal to one layer(s) ($L_n$), wherein n=0, −1, −2, . . . −i, wherein n=0 represents the greater than or equal to one layer(s) ($L_n$) of the load bearing surface that contacts the load, wherein n=−1, −2, . . . −i, represents successive underlying greater than or equal to one layer(s) ($L_n$) of the load bearing surface, wherein the greater than or equal to one layer(s) ($L_n$), except n=0 and n=−i, has greater than or equal to one opening(s) therein, wherein n=−i, represents a bottom underlying greater than or equal to one layer(s) ($L_n$) of the load wherein the greater than or equal to one opening(s) are aligned so that a center of each greater than or equal to one opening(s) underlies the pressure point of the person, wherein the fabric consists essentially of a polyurethane fiber and a fiber that is chemically different from the polyurethane fiber, wherein the fabric has been stretched between members of the chair frame so that the fabric's percent elongation approaches but is less than the percent elongation for the Young's Modulus, and wherein each greater than or equal to one opening(s) in each greater than or equal to one layer(s) ($L_n$) of the fabric, except n=0 and n=−i, is aligned on an axial axis of the fabric, and wherein each of the greater than or equal to one opening(s) in each successive greater than or equal to one layer(s) ($L_n$) of the fabric has a successively smaller area as n becomes increasingly negative.

26. An apparatus having a load bearing surface, comprising:

a chair frame;

a stretched fabric having greater than or equal to one layer(s) ($L_n$), wherein n=0, −1, −2, . . . −i, wherein n=0 represents the greater than or equal to one layer(s) ($L_n$) of the load bearing surface that contacts the load, wherein n=−1, −2, . . . −i, represents successive underlying greater than or equal to one layer(s) ($L_n$) of the load bearing surface, and wherein the greater than or equal to one layer(s) ($L_n$), except n=0 and n=−i, has greater than or equal to one opening(s) therein, wherein n=−i, represents a bottom underlying greater than or equal to one layer(s) ($L_n$) of the load wherein the greater than or equal to one opening(s) are aligned so that a center of each greater than or equal to one opening(s) underlies the pressure point of the person, wherein the fabric consists essentially of a polyurethane fiber and a fiber that is chemically different from the polyurethane fiber, wherein the fabric has been stretched between members of the chair frame so that the fabric's percent elongation approaches but is less than the percent elongation for the Young's Modulus, and wherein each greater than or equal to one opening(s) in each greater than or equal to one layer(s) ($L_n$) of the fabric, except n=0 and n=−i, is aligned on an axial axis of the fabric, and wherein each of the greater than or equal to one opening(s) in each successive greater than or equal to one layer(s) ($L_n$) of the fabric has a successively smaller area as n becomes increasingly negative, wherein a shape of the greater than or equal to one opening(s) is selected from the group consisting of a circle, an ellipse, a slit, a line, a zigzag, a rectangle, an ellipse having a serrated edge, and combinations thereof.

27. An apparatus for supporting a person, comprising:

a load bearing surface comprising a stretched fabric having greater than or equal to one layer(s) ($L_n$), wherein n=0, −1, −2, . . . −i, wherein n=0 represents the greater than or equal to one layer(s) ($L_n$) of the load bearing surface that contacts the load, wherein n=−1, −2, . . . −i, represents successive underlying greater than or equal to one layer(s) ($L_n$) of the load bearing surface, wherein the greater than or equal to one layer(s) ($L_n$) of the fabric, except n=0 and n=−i, has greater than or equal to one opening(s) therein, wherein the greater than or equal to one opening(s) are aligned so that a center of each greater than or equal to one opening(s) underlies the pressure point of the person, and wherein the fabric has been stretched so that the fabric's percent elongation approaches but is less than the percent elongation for the Young's Modulus.

28. An apparatus for supporting a person, comprising:

a load bearing surface having a stretched fabric having greater than or equal to one layer(s) ($L_n$), wherein n=0, −1, −2, . . . −i, wherein n=0 represents the greater than or equal to one layer(s) ($L_n$) of the load bearing surface that contacts the load, wherein n=−1, −2, . . . −i, represents successive underlying greater than or equal to one layer(s) ($L_n$) of the load bearing surface, wherein each of the greater than or equal to one opening(s) in each greater than or equal to one layer(s) ($L_n$) of the fabric, except n=0 and n=−i, is aligned on an axial axis of the fabric, and wherein each of the greater than or equal to one opening(s) in each successive greater than or equal to one layer(s) ($L_n$) of the fabric has a successively smaller area as n becomes increasingly negative, and wherein the fabric has been stretched so that the fabric's percent elongation approaches but is less than the percent elongation for the Young's Modulus.

29. An apparatus for supporting a person, comprising:

a load bearing surface;

a stretched fabric having greater than or equal to one layer(s) ($L_n$), wherein n=0, −1, −2, . . . −i, wherein n=0 represents the greater than or equal to one layer(s) ($L_n$) of the load bearing surface that contacts the load, wherein n=−1, −2, . . . −i, represents successive underlying greater than or equal to one layer(s) ($L_n$) of the load bearing surface, wherein a shape of the greater than or equal to one opening(s) is selected from the group consisting of a circle, an ellipse, a slit, a line, a zigzag, a rectangle, an ellipse having a serrated edge, and combinations thereof, and wherein the fabric has been stretched so that the fabric's percent elongation approaches but is less than the percent elongation for the Young's Modulus.

* * * * *